United States Patent [19]

Borgen

[11] Patent Number: 4,818,043

[45] Date of Patent: Apr. 4, 1989

[54] PRODUCT DISPLAY AND MARKETING DEVICE

[75] Inventor: Arden L. Borgen, Des Moines, Iowa

[73] Assignee: Margaret P. Borgen, Des Moines, Iowa

[21] Appl. No.: 49,733

[22] Filed: May 13, 1987

[51] Int. Cl.[4] ..... A47F 3/00

[52] U.S. Cl. ..... 312/138 R; 49/371; 297/116; 297/198; 297/296

[58] Field of Search ..... 312/116, 138 R, 198, 312/214, 296, 329, 109; 49/371, 501, 386; 16/275, 224, 273

[56] References Cited

U.S. PATENT DOCUMENTS

| | | | |
|---|---|---|---|
| 1,444,223 | 2/1923 | Tuomi | 49/371 X |
| 2,251,482 | 8/1941 | Curtiss, Jr. | 16/275 |
| 2,575,822 | 11/1951 | Lyon | 49/371 |
| 3,540,154 | 11/1970 | Claudio | 49/371 |
| 4,087,139 | 5/1978 | Heaney | 312/214 X |
| 4,223,482 | 9/1980 | Barroero et al. | 312/138 R X |

FOREIGN PATENT DOCUMENTS

| | | | |
|---|---|---|---|
| 3301524 | 7/1984 | Fed. Rep. of Germany | 312/198 |
| 131991 | 9/1919 | United Kingdom | 49/371 |
| A2167543 | 5/1986 | United Kingdom | 312/116 |
| A2183706 | 6/1987 | United Kingdom | 49/501 |

*Primary Examiner*—Peter A. Aschenbrenner
*Assistant Examiner*—Thomas A. Rendos
*Attorney, Agent, or Firm*—Zarley, McKee, Thomte, Voorhees & Sease

[57] ABSTRACT

The product display device of the present invention comprises a cabinet frame having a front opening therein. Two or more doors are positioned in covering relation over the front opening so as to form an enclosed compartment within the cabinet frame. Each of the doors includes an upper edge, a lower edge, a latching edge, a hinge edge, a front face and a rear face. The doors are arranged in side-by-side relationship with one another with the hinge edge of one door being adjacent the latching edge of the other door. The hinge edges of the doors are hinged at their upper and lower ends to the cabinet frame. A stop member is attached to the hinge edge of the first door and includes a latch surface extending laterally from the hinge edge and being in facing relationship to the rear face of the latching edge of the other door. A seal is attached to the rear face of the second door and sealingly engages the latch surface of the stop member of the first door to form a seal therebetween. A magnetic•latch is associated with the seal for detachably securing the latching edge of the second door to the hinge edge of the first door.

30 Claims, 3 Drawing Sheets

6A
6B

PRODUCT DISPLAY AND MARKETING DEVICE

BACKGROUND OF THE INVENTION

This invention relates to a product display and marketing device, and particularly to a display and marketing device for displaying and marketing refrigerated or frozen products such as refrigerated foods, floral products, frozen foods and the like.

Presently known display devices for refrigerated or frozen products generally include a plurality of doors which are openable at the front of the display device. These doors are opened often by customers, and therefore must be durable while at the same time being capable of easy opening and easy closing.

Presently existing doors for these display devices include rigid metal frames completely surrounding insulated glass panes. These metal frames fit within a corresponding metal frame in the cabinet itself. Thus, a plurality of vertical support members must be provided in the cabinet frame itself for accommodating the various doors therein.

While the aforementioned present structure provides reasonably good sealing around the doors, it does not present an attractive appearance from the exterior, since the rectangular frames of the doors and the rectangular frames for receiving the doors are visible to the customers. Furthermore, these rectangular frames interfere with the viewing by the customer of the merchandise within the cabinet. If the merchandise is positioned behind the rectangular frames of the doors, it is not readily visible by the customer.

Another disadvantage of present metal frame doors is that the metal frame is conductive of heat. Furthermore, the metal frame doors and the door frames for receiving the doors are subject to condensation and usually require anticondensation heaters to be placed therein. All this adds substantially to the refrigeration load necessary to maintain the device at the desired temperature.

Therefore, a primary object of the present invention is the provision of an improved product display device for refrigerated or frozen foods, flowers or other similar products requiring refrigeration.

A further object of the present invention is the provision of a display device having a plurality of glass doors which do not obstruct the view by the customer of the contents within the cabinet.

A further object of the present invention is the provision of a product display device which eliminates the necessity for vertical support frames adjacent the edges of the doors.

A further object of the present invention is the provision of a refrigerated product display device wherein the doors are made primarily of glass and do not include cumbersome rectangular frames surrounding the glass and obstructing the customer's view of the contents of the cabinet.

A further object of the present invention is the provision of a product display device which is attractive in appearance, effective in marketing, efficient in operation, and durable in construction.

SUMMARY OF THE INVENTION

The present invention utilizes a product display cabinet having a large front opening therein for accommodating a plurality of glass doors in side-by-side relation. The glass doors are capable of latching against one another, and therefore do not require vertical members on the cabinet frame for receiving each of the doors.

Each door comprises a glass panel assembly having a large rectangular exterior sheet of glass formed of tempered glass. Attached to the interior surface of the exterior glass are one or more laminated glass members which are spaced apart and which are smaller in size than the exterior glass sheet member. Because of this difference in size, the outer glass sheet member includes a rearwardly facing outer margin which extends beyond the outer margins of the interior glass sheet members.

Each door includes a vertical hinge edge and a vertical latching edge opposite the hinge edge. The hinge edge is hinged at its upper and lower ends to the cabinet frame for pivotal movement about a vertical axis. The doors are arranged with the latching edge of each door adjacent the hinge edge of an adjacent door.

Extending along the hinge edge of each door is a vertical stop member which includes a latch surface extending outwardly beyond the hinge edge of the door. This latching surface is adapted to be positioned in facing relationship to the rear face of the latching edge of the adjacent door. An elastomeric seal extends around three sides of each door, and includes a magnetic latch thereon. The magnetic latch is adapted to retentively engage the latch surface of the vertical stop member and in combination with the seal provides an elastomeric seal therewith.

The aforementioned structure does not require any vertical members within the door opening of the cabinet. Each door is supported by the glass sheet members rather than by a metal frame as in prior doors. The glass doors provide an attractive outer surface which is unobstructed by vertical support frames or door frames, and which provides a smooth continuous surface from one door to another. Each door can be separately opened and shut for access into the compartment. The use of unframed glass doors also eliminates the use of highly conductive material around the door and door opening thereby improving the efficiency of the unit.

DETAILED DESCRIPTION OF THE PREFERRED EMBODIMENT

Figure 1:
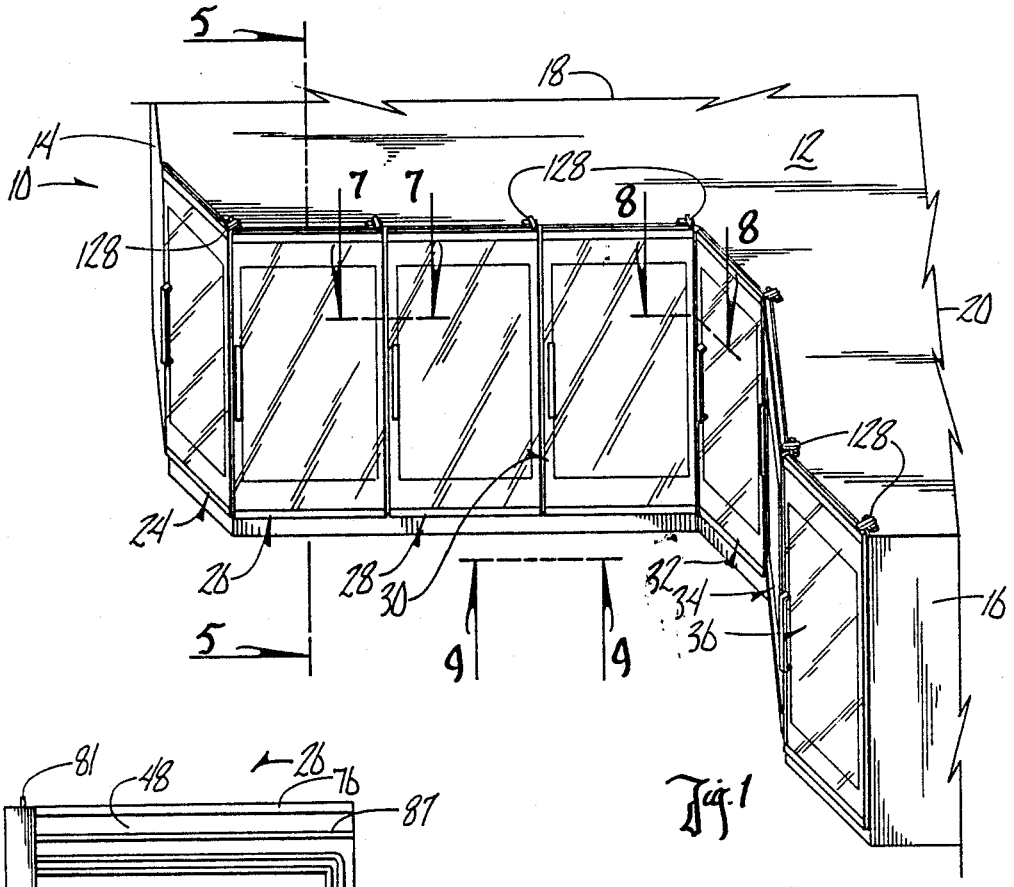
FIG. 1 is a perspective view of an irregularly shaped product display device of the present invention.
Figures 5, 6A, 6B:
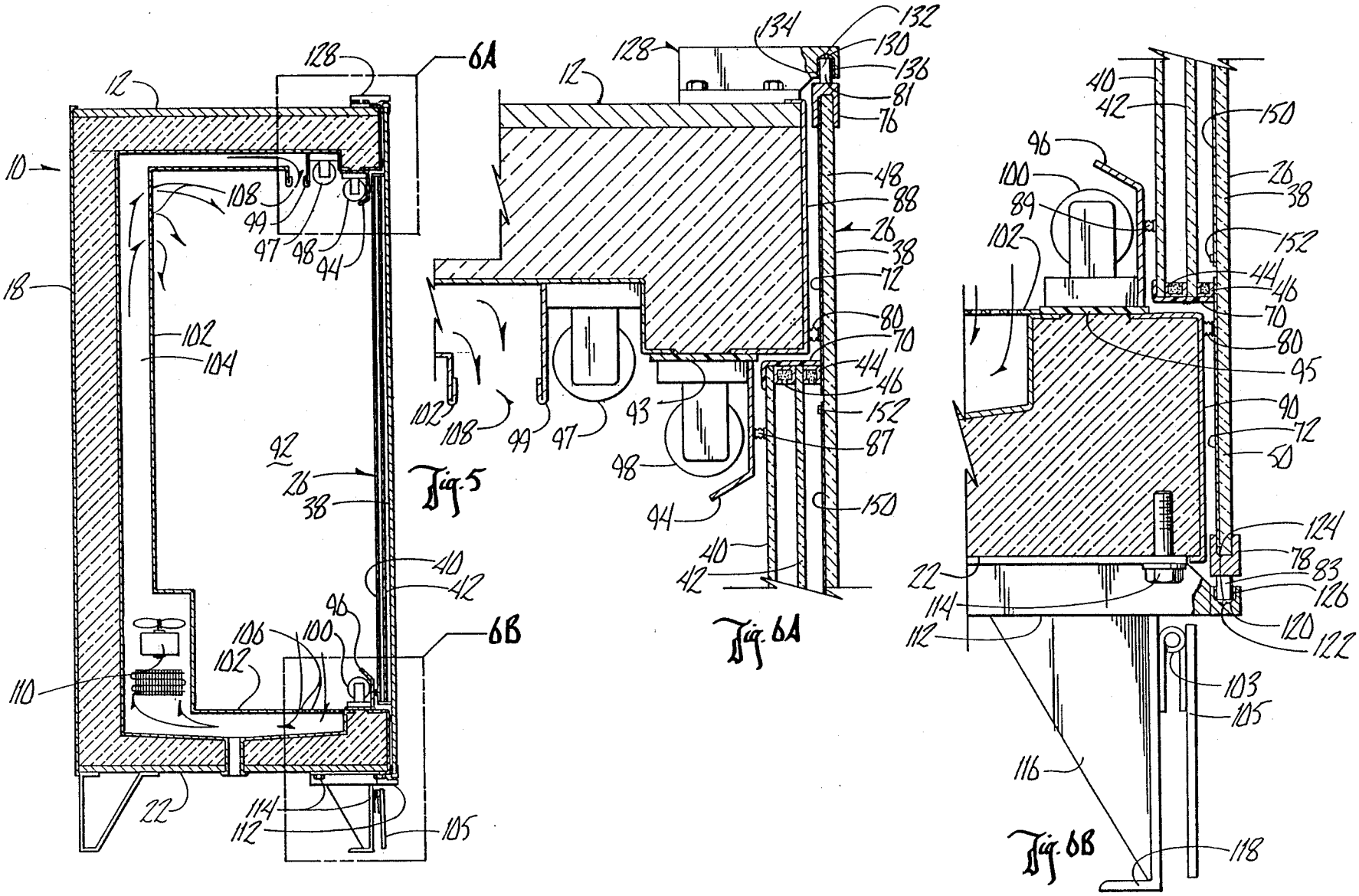
FIG. 5 is a sectional view taken along line 5—5 of FIG. 1.
FIGS. 6A a 6B are enlarged sectional views taken along lines 6A—6A and 6B—6B respectively, of FIG. 5.

Referring to the drawings, the numeral 10 generally refers to a product display device of the present invention. Device 10 comprises a display cabinet having a top wall 12, end walls 14, 16, rear walls 18, 20 and a bottom wall 22 (FIG. 5). Fitted over the front of device 10 in side-by-side relation are a plurality of doors 26, 28, 30, 32, 34 and 36. The number of doors may vary without detracting from the invention, but the doors shown in FIG. 1 illustrate the various irregular shapes which may be accommodated by the doors of the present invention. Presently known framed doors and openings do not permit this flexibility of design.

Figure 2:
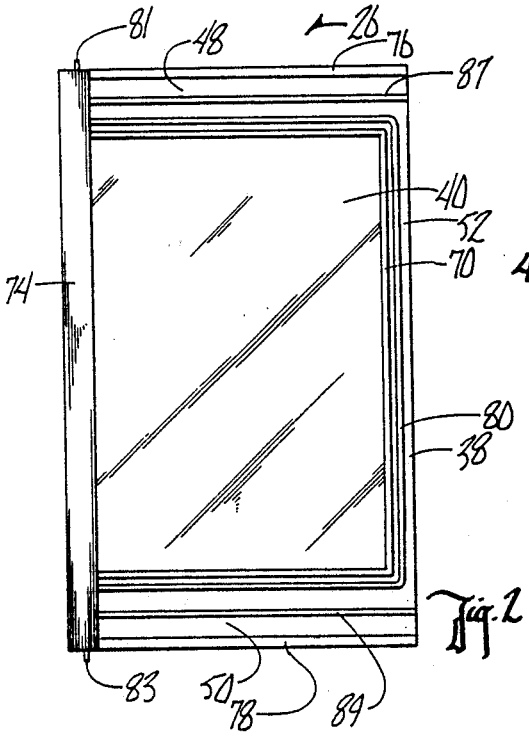
FIG. 2 is a rear elevational view of one of the doors of the present invention.
Figure 3:
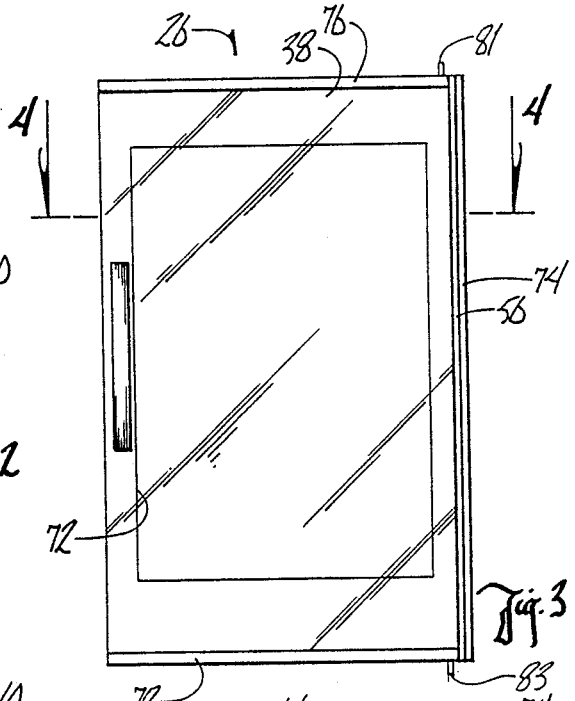
FIG. 3 is a front elevational view of one of the doors of the present invention.
Figure 4:
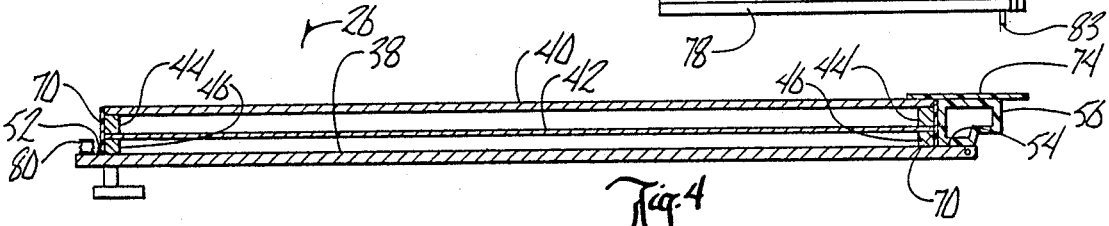
FIG. 4 is a sectional view taken along line 4—4 of FIG. 3.
Figure 7:
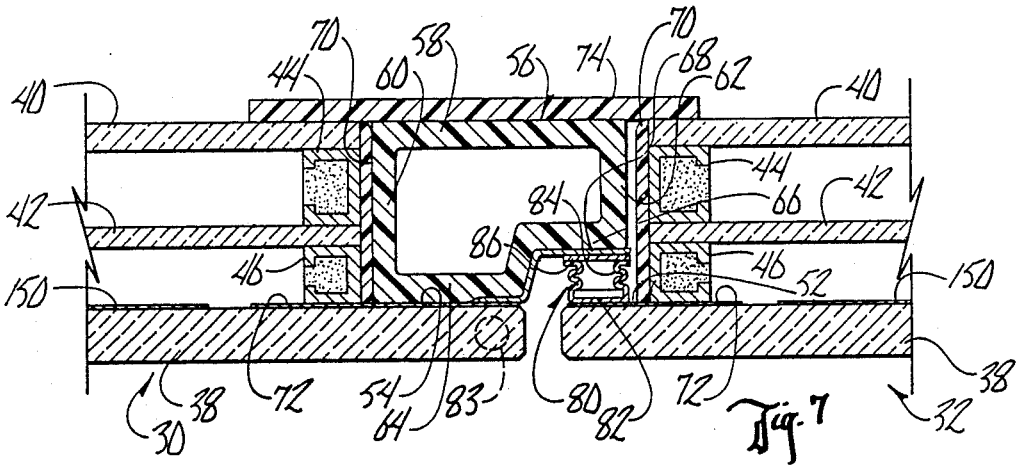
FIG. 7 is a sectional view taken along line 7—7 of FIG. 1.

The general structure of a typical door 26 is illustrated by door 26 in FIGS. 2–4. Door 26 includes an outer rectangular tempered glass panel 38. Attached to the inner surface of panel 38 are a pair of spaced apart glass panels 40, 42 which are held in spaced apart relation to one another and to panel 38 by seals 44, 46 which provide an insulated three pane construction. Panels 40 and 42 are smaller in length and width than panel 38, thereby exposing an upper edge margin 48, a lower margin 50, and opposite side margins 52, 54 which protrude beyond the outer perimeters of glass panels 40, 42. Operatively adhered by adhesive or other means to the side margin 54 is a vertical elongated stop member 56. Stop member 56 is preferably constructed of a rigid extruded plastic material. Stop member 56 is shown in detail in FIG. 7 and includes in cross-section a back wall 58, end walls 60, 62, a first front wall 64, and a stop surface 66. Covering stop surface 66 is a sheet of magnetic stainless steel 68, which while being stainless steel is capable of magnetically interacting with a magnet. As can be seen in FIG. 7, the edges of glass panels 40, 42 are covered with a protective plastic edging member 70. Also as can be seen in FIGS. 3 and 7, the perimeter of the interior surface of outer glass panel 38 is covered with an opaque coating 72 which covers up the seals 44, 46 and the extruded stop member 56 from view from the exterior of door 26. Coating 72 may be a paint, a fired ceramic coating, a mirror, or other suitable coating.

Extruded stop member 56 is fitted within the L-shape provided by edging member 70 and opaque coating 72, and is adhered in that position to door 26 so that the extruded member 56 is fixed to door 26. A plastic backing plate 74 is adhered to the surface 58 of extruded member 56 and as can be seen in FIG. 7, backing plate 74 extends outwardly from the opposite sides of extruded member 58.

Referring again to FIGS. 2–4, the door 26 includes a protective metal rail 76 attached to the upper edge of outer glass panel 38 and a metal rail 78 attached to the lower edge of outer glass panel 38. As can be seen in FIGS. 6A and 6B, the rails 76, 78 are U-shaped in cross-section and include upper and lower hinge pins 81, 83 adjacent the stop member 56.

The primary support structure for door 26 is the tempered outer glass panel 38 which is substantially thicker than the glass panels 40, 42 and which provides the basic structural integrity for the door. This is to be contrasted with prior doors which rely upon a rectangular metal frame for providing the structural integrity of the door. The present door does not require such a frame, and is a frameless door. The rails 76, 78 do not gave as their principal function the provision of structural support to the door, but instead are used to provide a means for mounting the hinge pins 81, 83 and also for protecting the lower and upper edges of the tempered glass panel 38.

Extending around the rearwardly facing margins 48, 50, 52 of outer glass panel 38 is an elongated sealing member 80 which is shown in cross-section in FIG. 7. Sealing member 80 comprises a backing strip 82 which is adhered or otherwise attached to the rearwardly facing margins 48, 50, 52 of outer glass panel 38. An elastomeric accordian-like central portion 84 is adapted to collapse toward and away from outer panel 38, and includes a magnetic strip 86 which is adapted to fit into retentive engagement with the magnetic stainless steel 68 on stop surface 66. Thus, as door 38 swings into facing engagement with stop member 56, the sealing member 80 moves into engagement with the stainless steel 68 on stop surface 66 and provides a latching engagement therewith. The sealing member 80 also engages a similar stainless steel strip 88 (FIG. 6A) attached to the forward edge of top wall 12 and engages a stainless steel strip 90 (FIG. 6B) on the forward edge of bottom wall 22 so as to provide a complete sealing engagement of doors 26, 28 and thereby provide a satisfactory enclosure for the compartment 92 within the device 10.

As can be seen in FIG. 2, a secondary upper seal 87 similar in cross-section to seal 80 is provided across the upper margin 48 of door panel 38 and a similar secondary lower seal 89 is provided across lower margin 50 of door panel 38. These secondary seals 87, 89 engage the stainless steel of light reflectors 94, 96, respectively as is shown in FIGS. 6A and 6B.

Referring to FIGS. 5 and 6, the top wall 12, the back wall 18, and the bottom wall 22 form a C-shaped construction in cross-section. The front edges of top wall 12 and bottom wall 22 are covered with the stainless steel sheeting 88, 90, respectively. Stainless steel sheeting 88 extends within the compartment 92 and terminates above a heat insulative gasket 93 which supports a light fixture 98. Light fixture 98 includes a stainless steel light shield 94. The front edge of bottom wall 22 includes a stainless steel cover 90 which extends within compartment 92 and terminates below a heat insulative gasket 95 which supports a light fixture 100. Light fixture 100 includes a stainless steel light shield 96. A third light fixture 97 is provided rearwardly and above light fixture 97 and includes a downwardly projecting light deflector 99 positioned rearwardly thereof. Light fixtures 97, 99 provide unique lighting to compartment 92. The deflector 94 deflects light rearwardly to the upper shelves within compartment 92, and the deflector 99 causes light to be directed toward the lower portion of compartment 92. This results in an eye pleasing even distribution of light within compartment 92 which is highly desirable for presenting the products within compartment 92 to the consumer. A lining 102 is provided on the interior of compartment 92 and provides an air passageway 104 along the bottom walls 22, the back wall 18 and the top wall 12. Lining 102 is provided with an air intake 106 and is also provided with a plurality of discharge openings 108 adjacent its upper and so as to permit the air to be taken in to passageway 104 through intake 106 and to be directed upwardly by a fan 110 toward the upper end of the passageway 104 where the air is expelled through discharge holes 108 into the upper portion of the chamber or compartment 92. This provides a continuous circulation of air within the compartment 92 so as to minimize the formation of frost therein, and so as to provide uniform distribution of temperature therein. Deflector 99, in addition to providing desirable deflection of light from fixture 97 also protects fixture 97 from being directly exposed to the freshly refrigerated air exiting from discharge openings 108.

Rigidly attached to the bottom surface of bottom wall 22 is a hinge bracket 112 which is held in place by bolts 114. Bracket 12 includes a triangular gusseted leg 116 which has a foot 118 on its lower end. Bracket 112, gusseted leg 116 and foot 118 are of solid integral construction so that the bracket 112 is rigidly held in place by virtue of the eight of the device 110 resting upon foot 118. Bracket 112 includes a hinge pin cup 120 having a cone-shaped lower end 122 in which is received a ball bearing 124. The upper end of cup 120 includes a bushing 126. Hinge pin 83 of each door extends downwardly into bushing 126 and rests upon ball bearing 124. Attached to upper wall 12 is a similar hinge bracket 128 having a cup 130 with a pointed inner end 132 which receives a ball bearing 134. A bushing 136 is also provided in cup 130. Upper hinge pin 81 is inserted into cup 130 and rotates within bushing 136 and against ball bearing 132. It has been found that these hinges are very satisfactory for bearing the heavy load produced by the glass panel doors 24, 26, 28, 30, 32, 34 and 36. The rigid connection of the bottom hinge bracket 112 to the bottom wall 22 provides a stable base for the hinge pin 82. This is further enhanced by virtue of the fact that the bracket 112 is integral with the leg 116 and foot 118 and is rigidly attached to the under surface of bottom wall 22. The weight of the device 10 enhances the strength and stability of the cup 120 and the hinge provided by the insertion of pin 82 into cup 120. Furthermore, the ball bearing 124 and the upper ball bearing 132 provide a substantially reduced friction to the hinged movement of the doors.

Attached to foot 118 is a piano-type hinge 103 to which is attached a kick plate 105. Kick plate 105 is preferably in the form of a highly polished stainless steel or mirror surface. The hinge 103 permits kick plate 105 to be pivoted upwardly so as to permit cleaning beneath the device 10.

Figure 8:
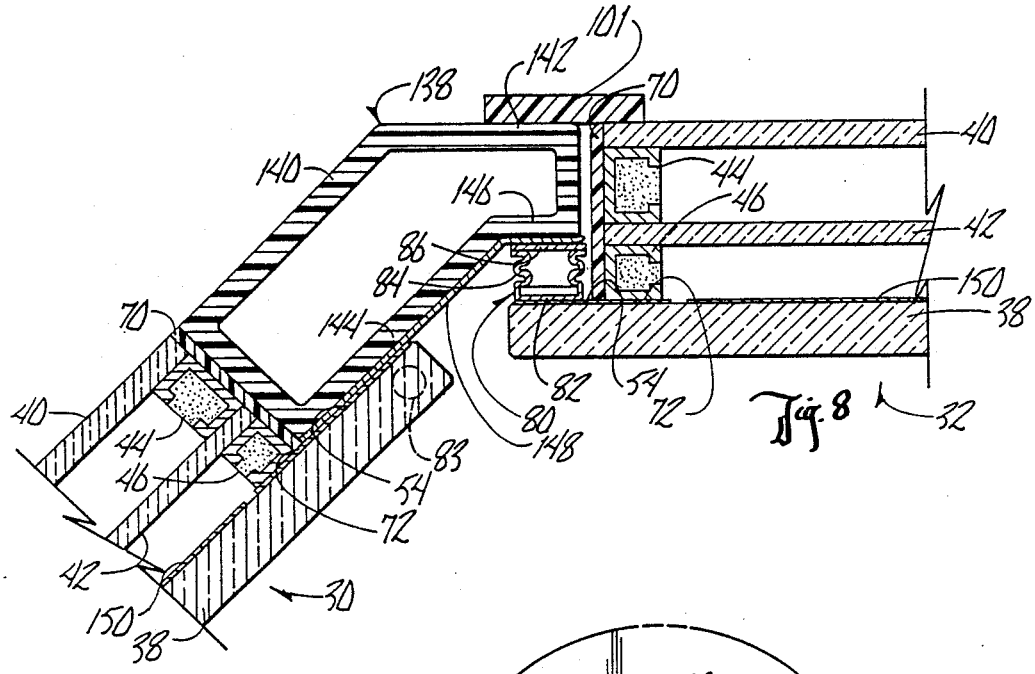
FIG. 8 is a sectional view taken along line 8—8 of FIG. 1.

FIG. 8 is a sectional view taken along line 8—8 of FIG. 1, and shows how the doors 30, 32 form a seal when the angle between the doors 30, 32 is less than 180°. This is accomplished by the utilization of a stop member 138 having a slightly different cross-sectional configuration from the stop member 56 shown in FIG. 7. Stop member 138 is provided with two rear walls 140, 142 which are angularly disposed with respect to one another and with two front walls 144, 146. A magnetic stainless steel strip 148 is provided over surfaces 144, 146 and is angled at an angle which conforms to the angles of the two doors 30, 32. The magnet 86 of door 38 is adapted to engage the stainless steel 148 which covers surface 146 of stop member 138.

Other shapes of extruded members 138 can be used to provide varying angles of intersection between the various doors. The respective angles of the surfaces 144, 146 shown in FIG. 8 may be changed to accommodate any particular angle whether that angle be greater than or less than 180°. Thus, complete flexibility is possible in the shape and angles of the doors of various configurations, and the configuration shown in FIG. 1 illustrates these various angles which may be employed.

All four edges of each door are provided with thermal breaks which minimize the conduction of heat from outside the door to the interior of compartment 92. For example, the stainless steel sheet 88 (FIG. 6A) is separated from the stainless steel shield 94 by insulative gasket 93 so that heat cannot be conducted directly therebetween. Gasket 93 also acts as a barrier between sheet 88 and other metal components within compartment 92.

Similarly gasket 95 (FIG. 6B) acts as a barrier between stainless steel sheet 90 and shield 96, as well as other metal components within compartment 92. Secondary seals 87, 89 further facilitate the thermal break by preventing cold air from being directly exposed to stainless steel sheets 88, 90 respectively.

The thermal break for the vertical edges of the doors is illustrated in FIGS. 7 and 8. In FIG. 7, the stainless steel strip 68 terminates adjacent seal 80, thereby providing a thermal break which prevents heat from being conducted through strip 68 to the interior of compartment 92. The fact that stop member 56 and backing plate 74 are constructed of plastic further impedes conduction of heat into the interior of compartment 92.

In FIG. 8, a similar construction is shown. Stainless steel sheet 148 terminates adjacent seal 80, and the plastic construction of stop member 138 and backing plate 101 further contributes to providing a thermal break between the interior and exterior of compartment 92.

Figure 9:
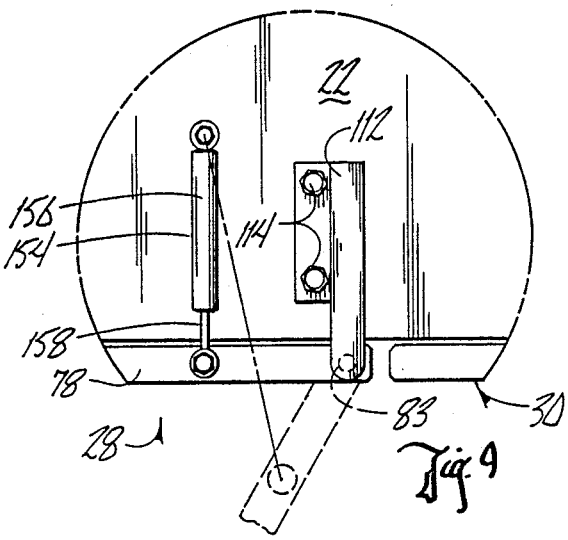
FIG. 9 a bottom view taken along line 9—9 of FIG. 1.

The interior surface of outer glass panel 38 may be provided with a transparent electrical conductor film 150 which includes an electrical connection 152 (FIGS. 6A and 6B) for connection to outside lead wires (not shown). Film 150 is capable of providing heat to the interior surface of outer panel 38 so as to minimize the formation of steam, frost or condensation on the surface of outer panel 38. Referring to FIG. 9, a closure member 154 is shown and includes a cylinder 156 and a spring loaded rod 158. The closer 154 is adapted to permit the door 126 to pivot outwardly to the position shown in shadow lines in FIG. 9 against the spring bias of the spring loaded rod 158. However, when the customer releases the door, the spring loaded rod 158 retracts within cylinder 156, thereby returning the door to its closed position.

Thus, it can be seen that the present invention provides a frameless glass door which presents an attractive outer appearance to the customer. Furthermore, the various doors are latched to one another rather than to a door frame or mullion post as in conventional devices, thereby making the products within the display case more visible to the customer.

The glass panels of the door provide the structure to the door as opposed to the use of metal frames containing thin glass plates in prior art devices. The hinge arrangement of the present door permits the weight of the door to be borne on a Nylon bushing in a cup having a ball bearing at the bottom thereof. The hinge pin rests on the ball bearing and provides a minimum of friction, while at the same time providing solid support for the hinge of the door.

The doors of the present invention may be placed at a plurality of angles with respect to one another so as to provide an infinite number of possibilities of design shapes and sizes for the cabinet. Thus, it can be seen the device accomplishes at least all of its stated objectives.

What is claimed is:

1. A product display device comprising:

a cabinet frame having a back wall, a top wall, opposite end walls, and a bottom wall, said top, end and bottom walls having front wall edges defining a front opening in said cabinet frame;

at least first and second doors positioned in covering relation over said front opening so as to form an enclosed compartment within said cabinet frame, each of said doors being rectangular in shape with an upper edge, a lower edge, a latching edge, a hinge edge, a front face, and a rear face, said doors being arranged in side-by-side arrangement with said hinge edge of said first door being adjacent said latching edge of said second door;

said first and second doors each being formed from at least a first rectangular transparent sheet which is frameless and which provides the primary structural integrity of said door;

hinge means connecting each of said first and second doors to said cabinet frame for pivotal movement about a vertical hinge axis located adjacent said hinge edge;

a stop member being attached to and extending along the length of said hinge edge of said first door, said stop member extending laterally beyond said hinge edge of said first door and having a latch surface in facing relation to said rear face of said second door adjacent said latching edge thereof;

sealing means attached to said rear face of said second door and extending along and adjacent to said latching edge of said second door for sealingly engaging said latch surface of said stop member of said first door to form a seal therebetween;

said hinge means and said stop means being positioned with respect to each of said first and second doors so as to permit each of said first and second doors to be separately and independently opened with respect to said front opening of said cabinet frame without opening the other of said doors;

latch means associated with said sealing means for detachably securing said latching edge of said second door to said hinge edge of said first door;

said front opening being free from walls, mullions, and columns therein whereby said opening is covered only by said first and second doors.

2. A device according to claim 1 wherein said rear faces of said first and second doors are in first and second vertical planes which are at an angle of less than 180° with respect to each other.

3. A device according to claim 1 wherein said rear faces of said first and second doors are in vertical planes which are at an angle of greater than 180° with respect to each other.

4. A device according to claim 1 wherein said hinge means are connected to said first and second doors only adjacent said upper and lower edges of said first and second doors.

5. A device according to claim 1 wherein sad front opening of said cabinet is free from vertical members adjacent said stop member of said first door and said latching edge of said second door.

6. A device according to claim 1 wherein each of said first transparent sheets of said first and second doors is comprised of glass.

7. A device according to claim 6 wherein each of said doors comprise at least a second rectangular glass sheet, spacer means securing said first and second glass sheets together in parallel spaced relation and forming a sealed envelope therebetween, said first sheet having a greater height and width than said second sheet so as to expose marginal surface of said first sheet extending outwardly beyond the perimeter of said second sheet.

8. A device according to claim 7 wherein said marginal surface of said first sheet faces rearwardly toward said enclosed compartment and forms a part of said rear face, and sealing means of said second door being attached to said marginal surface thereof.

9. A device according to claim 8 wherein said second sheet is positioned adjacent said compartment and said first sheet is positioned outwardly in covering relation with respect to said second sheet.

10. A device according to claim 9 wherein said stop member comprises an elongated member attached to said hinge edge of said first door, said latch surface of said stop member comprising an elongated flat surface extending along and in facing relation to a portion of said marginal surface of said second door.

11. A device according to claim 10 wherein said latch surface comprises a magnetizable metal and said latch means comprises a magnet attached to said second door and detachably engaging said latch surface.

12. A product display device according to claim 1 comprising first and second light fixtures positioned within said compartment adjacent said top wall, said first light fixture having a bulb and a deflector, said deflector being between said bulb and said doors and extending downwardly and then rearwardly toward said rear wall, said second light fixture having a second bulb and a second deflector located between said second bulb and said back wall, said second deflector extending downwardly below said second bulb.

13. A product display device comprising:

a cabinet frame having a back wall, a top wall, and opposite end walls, said top and end walls having front wall edges and defining a forwardly presented front opening in said cabinet frame;

at least first and second doors positioned in covering relation over said front opening so as to form an enclosed compartment within said cabinet frame, each of said doors comprising at least one transparent panel having an upper edge, a lower edge, a latching edge, a hinge edge, a front face and a rear face, said one transparent panels of said first and second doors being free from rectangular framing and being sufficiently thick and strong to provide the primary structural integrity for said first and second doors, respectively, said hinge edge of said one transparent panel of said first door and said latching edge of said one transparent panel of said second door being closely adjacent one another and free of frames therebetween;

a stop member attached to said first door and having a forwardly facing latching surface extending laterally beyond said hinge edge of said one transparent panel of said first door;

sealing means between said second door and said latching surface of said stop member of said first door and providing an air seal therebetween.

14. A product display device according to claim 13 and further comprising refrigeration means for cooling the air within said enclosed compartment, said one transparent panels of said first and second doors being comprised of glass.

15. A product display device according to claim 14 wherein said first and second doors each comprise at least two glass panels secured to one another in parallel spaced relation.

16. A product display device according to claim 15 wherein the space between said two spaced apart glass panels is sealed so as to provide a thermal insulation barrier over said front opening of said enclosed compartment.

17. A product display device according to claim 16 wherein each of said first and second doors comprise at least three glass panels secured to one another in parallel spaced relation.

18. A product display device according to claim 13 wherein said front faces of said one transparent panels of said first and second doors are in coinciding vertical planes.

19. A product display device according to claim 13 wherein said front faces of said one transparent panels of said first and second doors are in vertical planes which are at an angle with respect to one another.

20. A refrigerated product display device comprising:

a cabinet frame having a back wall, a top wall, and opposite end walls, said top, and end walls having front wall edges defining a front opening in said cabinet frame;

at least first and second doors positioned in covering relation over said front opening so as to form an enclosed compartment within said cabinet frame, each of said doors comprising at least one transparent panel which is rectangular in shape with an upper edge, a lower edge, a latching edge, a hinge edge, a front face, and a rear face, said doors being arranged in side-by-side arrangement with said hinge edge of said transparent panel of said first door being closely adjacent said latching edge of said transparent panel of said second door;

refrigeration means for cooling the air within said enclosed compartment;

hinge means connecting each of said first and second doors to said cabinet frame for pivotal movement about a vertical hinge axis located adjacent said hinge edge;

a stop member being attached to and extending along the length of said rear face of said hinge edge of said transparent panel of said first door, said stop member extending laterally beyond said hinge edge of said transparent panel of said first door and having a latch surface located completely rearwardly of said transparent panels of said first and second doors and positioned in facing relation to said rear face of said transparent panel of said second door adjacent said latching edge thereof;

sealing means mounted to said rear face of said transparent panel of said second door and extending along and adjacent to said latching edge of said glass panel of said second door for sealingly engaging said latch surface of said stop member of said first door to form a seal therebetween, said entire sealing means being located inwardly from said latching edge of said glass panel of said second door;

latch means detachably securing said latching edge of said transparent panel of said second door to said stop member of said first door.

21. A door comprising:

a rectangular transparent panel assembly having a forwardly presented face and a rearwardly presented face and comprising at least a first rectangular transparent panel, a second rectangular transparent panel, and sealing means connecting said first and second transparent panels together in parallel spaced relation to one another so as to form a sealed envelope therebetween, each of said first and second transparent panels having a front face, a rear face, an upper edge, a lower edge, and opposite side edges;

said first transparent panel forming said front face of said assembly, being free from rectangular framing, and being sufficiently strong and thick to provide the primary structural support for said panel assembly;

said transparent panel assembly having an upper edge, a lower edge, a hinge edge, and a latching edge;

hinge means connected to said panel assembly adjacent said hinge edge thereof for permitting said panel assembly to be mounted for hinged movement about a vertical hinge axis adjacent said hinge edge;

an elongated stop member adjacent only said hinge edge of said panel assembly, said stop member being connected to said rearwardly presented face of said panel assembly and having a forwardly presented latch surface protruding laterally beyond said hinge edge of said panel assembly; elongated sealing means on said rear face of said panel assembly and extending along a line adjacent said latching edge thereof.

22. A door according to claim 21 wherein said forwardly presented latch surface of said latch member is a vertical surface which commences at said rear face of said panel assembly at said hinge edge thereof and extends laterally outwardly therefrom.

23. A door according to claim 22 wherein said latch surface includes at least a first portion thereof which is parallel to said rear face of said panel assembly adjacent said hinge edge thereof.

24. A door according to claim 23 wherein said latch surface includes at least a second portion which is angled with respect to said rear face of said panel assembly adjacent said hinge edge thereof.

25. A door according to claim 21, wherein said first and second transparent panels are comprised of glass, one of said opposite side edges of said first glass panel protruding laterally outwardly beyond said second glass panel to form a latching portion of said first glass panel, said sealing and latching means having a first portion being mounted on said rear face of said latching portion of said first glass panel.

26. A door according to claim 25 wherein said upper and lower edges of said first glass panel protrude upwardly and downwardly from said upper and lower edges of said second glass panel respectively to form upper and lower protruding portions respectively of said first glass panel, said sealing and latching means having second and third portions mounted on said rear faces of said upper and lower protruding portions respectively of said first glass panel.

27. A door according to claim 26 wherein the other of said opposite side edges of said first panel protrudes laterally outwardly beyond said second glass panel to form a hinge portion of said first glass panel, said stop member being mounted on said rear face of said hinge portion of said first glass panel.

28. A door according to claim 21 wherein said first transparent panel is comprised of tempered glass and is thicker than said second panel.

29. A door according to claim 21 and further comprising a third rectangular transparent panel having the same dimensions as said second transparent panel, second sealing means sealing said third transparent panel to said second transparent panel in parallel spaced apart registered alignment therewith so as to provide a second sealed envelope therebetween.

30. A door comprising:

a rectangular transparent panel assembly having a front face, a rear face, an upper edge, a lower edge, a hinge edge, and a latching edge;

said transparent panel assembly comprising at least one rectangular transparent panel forming said front face and having an upper panel edge, a lower panel edge, and opposite side panel edges, said one transparent panel being free from rectangular framing and being sufficiently strong and thick to provide the primary structural support for said panel assembly;

hinge means connected to said panel assembly adjacent said hinge edge thereof for permitting said panel assembly to be mounted for hinged movement about a vertical hinge axis adjacent said hinge edge;

an elongated stop member connected to said rear face of said panel assembly adjacent only said hinge edge of said panel assembly and having a adjacent only said hinge edge of said panel assembly, said stop member being forwardly presented latch surface protruding laterally beyond said hinge edge of said panel assembly;

elongated sealing and latching means on said rear face of said panel assembly and extending along a line adjacent said latching edge thereof.

* * * * *